US008522738B2

(12) United States Patent
Shibata et al.

(10) Patent No.: US 8,522,738 B2
(45) Date of Patent: Sep. 3, 2013

(54) VEHICLE ENGINE

(75) Inventors: Manabu Shibata, Nishio (JP); Hitoshi Tsuge, Takahama (JP)

(73) Assignee: Otics Corporation, Aichi (JP)

( * ) Notice: Subject to any disclaimer, the term of this patent is extended or adjusted under 35 U.S.C. 154(b) by 149 days.

(21) Appl. No.: 12/966,242

(22) Filed: Dec. 13, 2010

(65) Prior Publication Data

US 2011/0162609 A1 Jul. 7, 2011

(30) Foreign Application Priority Data

Jan. 7, 2010 (JP) ..... 2010-001987

(51) Int. Cl.
*F01M 9/10* (2006.01)

(52) U.S. Cl.
USPC ..... 123/90.38; 123/90.43; 123/195 C; 123/193.5

(58) Field of Classification Search
USPC ..... 123/90.1, 90.12, 90.38, 90.43, 196 M, 123/196 R, 90.45, 90.15, 90.16, 90.39, 193.5, 123/195 R, 195 C, 195 HC
See application file for complete search history.

(56) References Cited

U.S. PATENT DOCUMENTS

| | | | | |
|---|---|---|---|---|
| 6,732,687 | B2 * | 5/2004 | Djordjevic | 123/90.16 |
| 7,377,246 | B2 * | 5/2008 | Maassen | 123/90.34 |
| 7,574,991 | B2 * | 8/2009 | Kumagai et al. | 123/195 C |
| 7,677,211 | B2 * | 3/2010 | Patel et al. | 123/90.12 |
| 7,757,646 | B2 * | 7/2010 | Kumagai et al. | 123/90.38 |
| 8,042,508 | B2 * | 10/2011 | Kumagai et al. | 123/90.38 |
| 8,127,727 | B2 * | 3/2012 | Methley et al. | 123/90.16 |
| 8,201,538 | B2 * | 6/2012 | Imazato | 123/196 M |
| 2009/0000585 | A1 * | 1/2009 | Sasaki et al. | 123/90.45 |
| 2010/0192887 | A1 * | 8/2010 | Iwata | 123/90.17 |

FOREIGN PATENT DOCUMENTS

| | | | |
|---|---|---|---|
| DE | 10041975 | A1 * | 3/2001 |
| JP | 2008-075482 | | 4/2008 |
| JP | 2011-117423 | | 6/2011 |

* cited by examiner

*Primary Examiner* — Thomas Denion
*Assistant Examiner* — Daniel Berstein
(74) *Attorney, Agent, or Firm* — Wenderoth, Lind & Ponack, L.L.P.

(57) ABSTRACT

A vehicle engine includes: a cylinder head; a cam housing fixed to a top of the cylinder head; a cam cap fixed to a top of the cam housing; a camshaft that is rotatably supported between the cam housing and the cam cap; a cam provided around the camshaft; a rocker arm that is pushed by the cam; a supporting member that supports one end of the rocker arm from below; a cylindrical bore portion for mounting the supporting member; and a base portion for supporting a bottom surface of the supporting member. The bore portion is provided integrally with the cam housing. The base portion is provided integrally with the cylinder head.

14 Claims, 5 Drawing Sheets

VEHICLE ENGINE

CROSS REFERENCE TO RELATED APPLICATION

This application claims priority from Japanese Patent Application No. 2010-001987 filed Jan. 7, 2010. The entire content of this priority application is incorporated herein by reference.

TECHNICAL FIELD

The present invention relates to vehicle engines.

BACKGROUND

Conventionally, a vehicle engine includes: a cylinder head; a cam housing fixed to a top of a cylinder head; a cam cap fixed to a top of the cam housing; a camshaft rotatably supported between the cam housing and the cam cap; a cam provided around the camshaft; a rocker arm configured to be pushed by the cam; and a lash adjuster that supports one end of the rocker arm from below. One of such vehicle engines includes a cam housing having a mounting recess, wherein the lash adjuster is mounted.

In such a vehicle engine, when the cam pushes the rocker arm, the pressure of the cam is exerted sequentially on the rocker arm, the lash adjuster, and the cam housing.

Therefore, the cam housing of the conventional vehicle engine needs to have a higher rigidity so as not to deform under the pressure of the cam.

In order to provide the higher rigidity of the cam housing, thickening the cam housing is necessary. However, thickening the cam housing can result in upsizing and weight increase of the cam housing. Accordingly, the space on the top of the cylinder head for fixing such a cam housing can be insufficient.

Thus, there is a need for a vehicle engine that exerts less pressure of the cam on the cam housing so as to permit downsizing of the cam housing.

SUMMARY

An aspect of the present invention is a vehicle engine including: a cylinder head; a cam housing fixed to a top of the cylinder head; a cam cap fixed to a top of the cam housing; a camshaft that is rotatably supported between the cam housing and the cam cap; a cam provided around the camshaft; a rocker arm that is pushed by the cam; a supporting member that supports one end of the rocker arm from below; a cylindrical bore portion for mounting the supporting member; and a base portion for supporting a bottom surface of the supporting member. The bore portion is provided integrally with the cam housing. The base portion is provided integrally with the cylinder head.

DETAILED DESCRIPTION

<Embodiment>

An embodiment in accordance with the present invention will hereinafter be described with reference to drawings.

Figure 4:
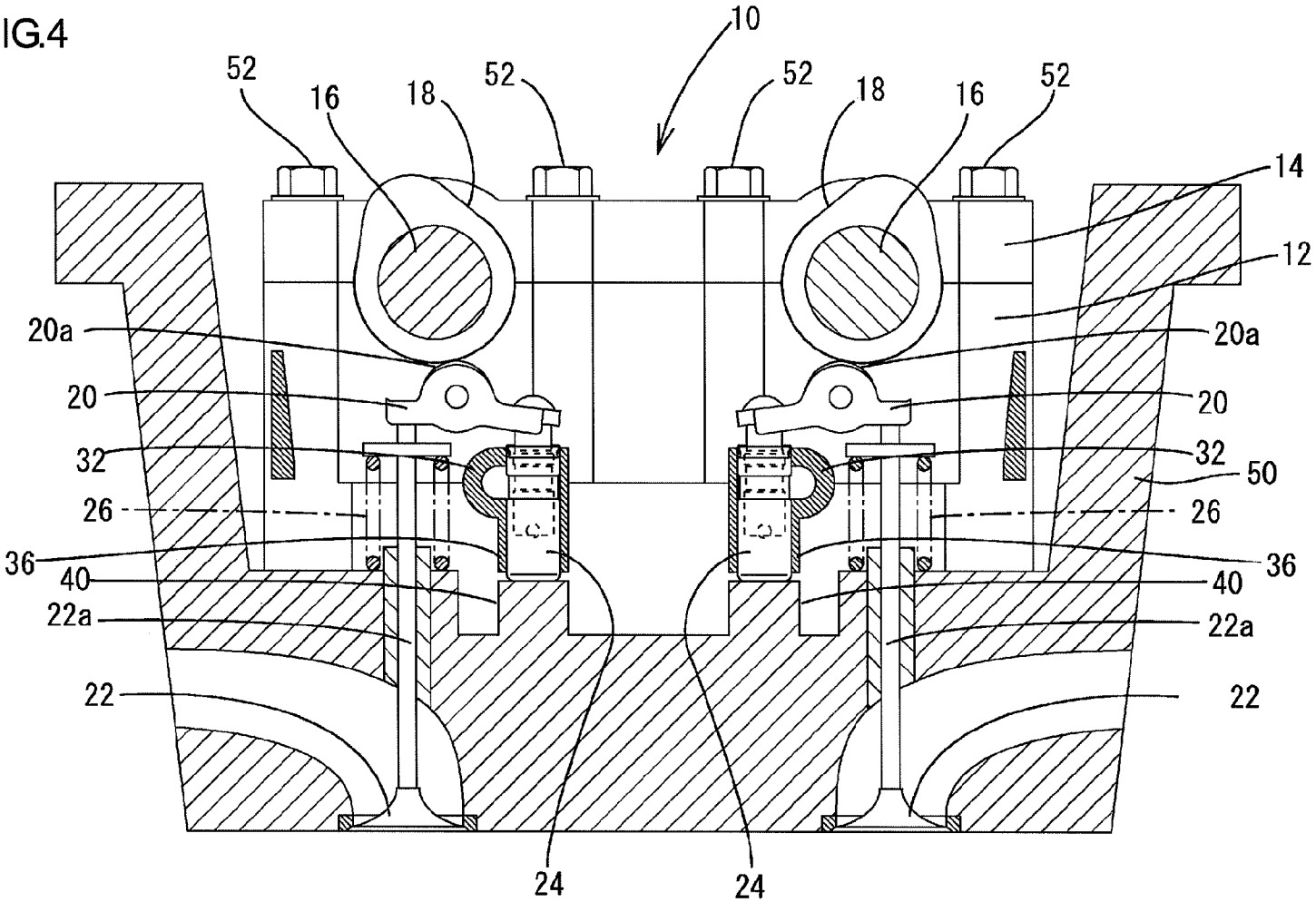
FIG. 4 is a sectional view of a vehicle engine.

As illustrated in FIG. 4, a vehicle engine 10 of this embodiment includes a cylinder head 50, a cam housing 12, a cam cap 14, camshafts 16, cams 18, rocker arms 20, and valves 22. The cam housing 12 is fixed to a top of the cylinder head 50. The cam cap 14 is fixed to a top of the cam housing 12. The camshafts 16 are rotatably supported between the cam housing 12 and the cam cap 14. The cams 18 are provided around the camshafts 16. The cams 18 can push the rocker arms 20. The rocker arms 20 can push the valves 22 so that the valves 22 operate. The vehicle engine 10 is a so-called DOHC engine, including the left and right camshafts 16 for operating the intake and exhaust valves 22, respectively.

As illustrated in FIG. 4, the cam housing 12 and the cam cap 14 are bolted on the top of the cylinder head 50 with bolts 52.

One end of each rocker arm 20 is supported from below by a corresponding lash adjuster 24. The other end contacts a stem 22*a* of the corresponding valve 22 from above. The lash adjuster 24 corresponds to a "supporting member".

As a crankshaft (not illustrated in the drawings) rotates, the camshafts 16 rotate so that the cams 18 push down rollers 20*a* of the rocker arms 20. Then, the rocker arms 20 swing up and down about top ends of the lash adjusters 24 while reciprocating the valves 22 up and down against the elastic forces of valve springs 26. Thus, the camshafts 16, the cams 18, the rocker arms 20, the lash adjusters 24, and the valve springs 26 configure a valve train for operating the valves 22.

The cam housing 12 and the cam cap 14 are made by finishing (e.g. cutting) metal cast (e. g. aluminium alloy cast). The cam housing 12 and the cam cap 14 can be manufactured by, for example, die casting.

Figure 3:
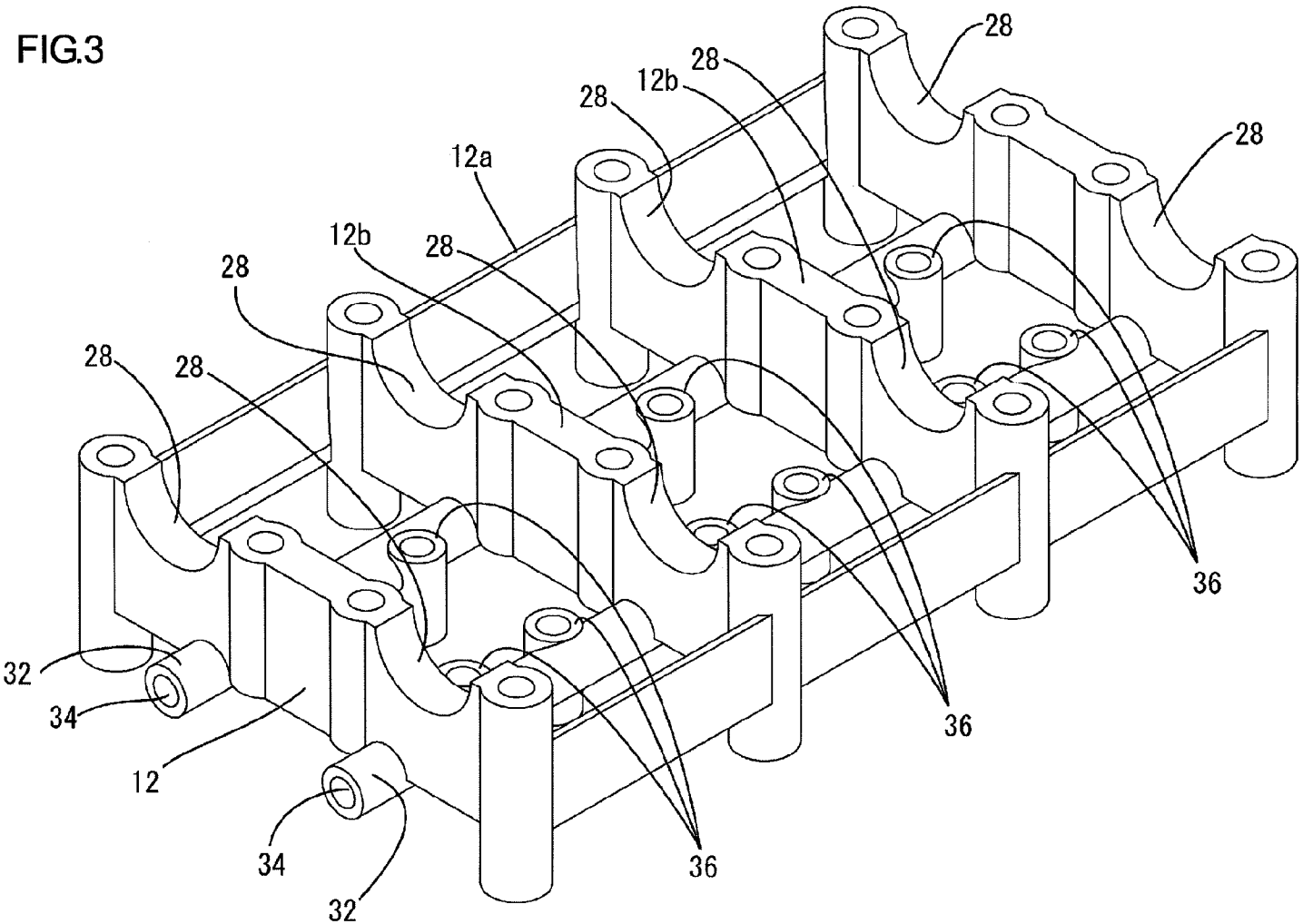
FIG. 3 is a perspective view of the cam housing.

As illustrated in FIG. 3, the cam housing 12 includes a rectangular outer frame 12*a* and partitions 12*b*. The outer frame 12*a* defines a space, while the partitions 12*b* partition the space into a plurality of subspaces. Each of the subspaces defined by the partitions 12*b* accommodates the valve train components for operating the cylinder valves 22.

Figure 1:
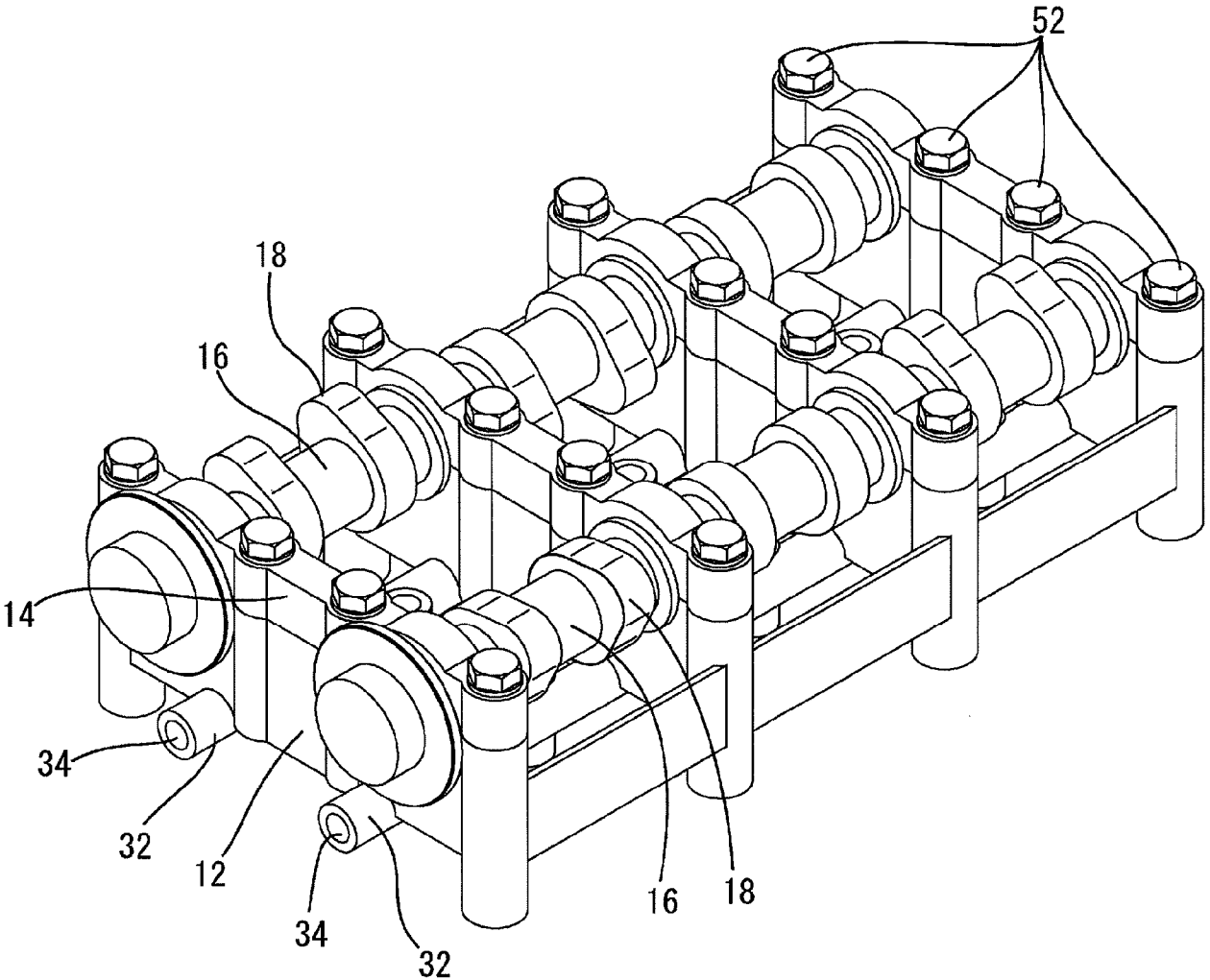
FIG. 1 is a perspective view illustrating a state in which a cam housing, a cam cap, and camshafts are assembled together.
Figure 2:
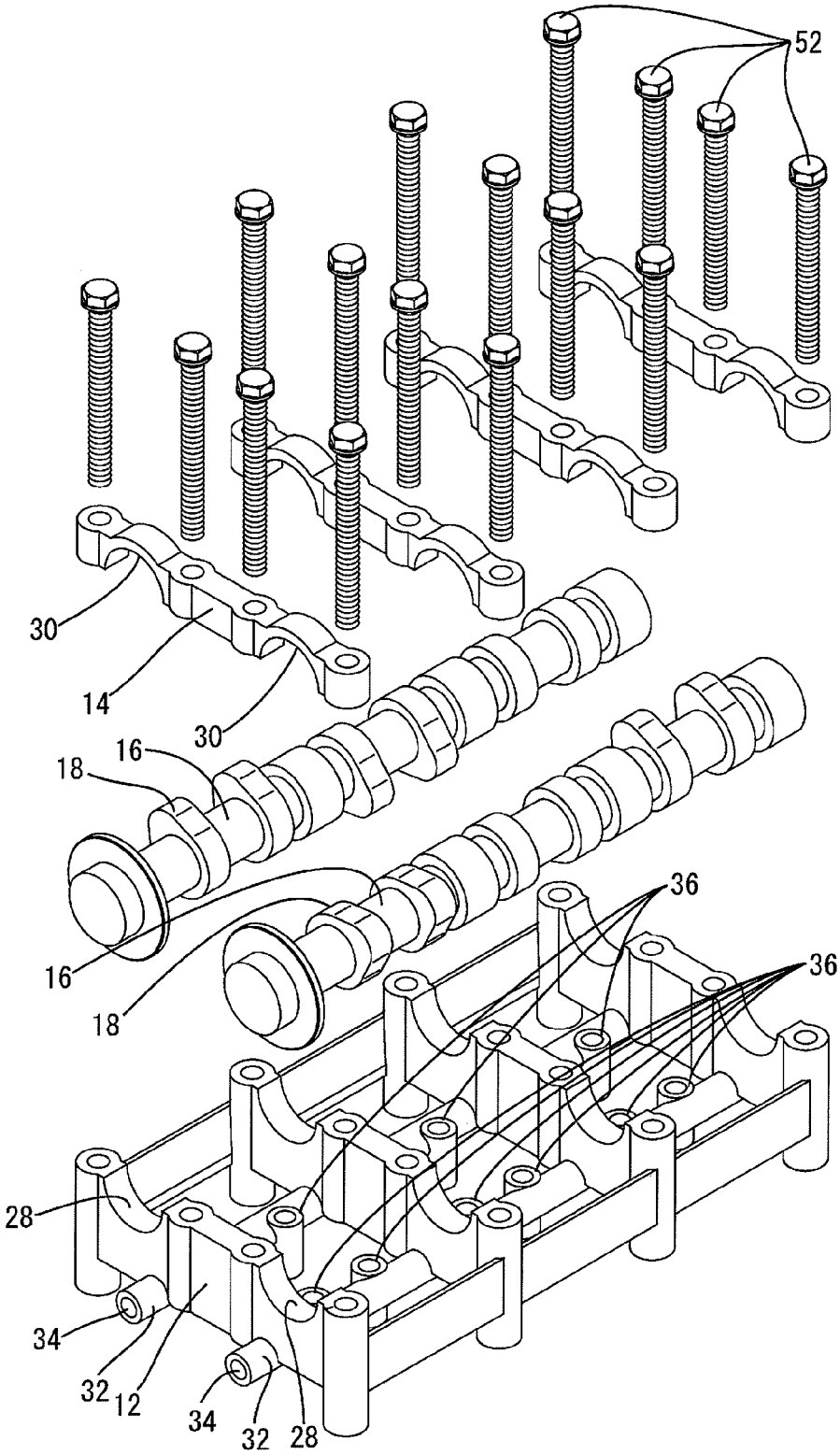
FIG. 2 is a perspective view illustrating a state before the cam housing, the cam cap, and the camshafts are assembled together.

As illustrated in FIG. 2, each camshaft 16 is a round bar made with metallic material such as JIS STKM (Carbon Steel Tubes for Machine Structural Purposes). The cams 18 are integrally provided on the circumference of the camshaft 16. The cams 18 are arranged in the axial direction of the camshaft 16.

Each camshaft 16 is rotatably supported between the cam housing 12 and the cam cap 14. Specifically, the camshaft 16 is rotatably supported between bearing recesses 28 and bearing recesses 30. Each of the bearing recesses 28, 30 is generally semicircular in cross section. The bearing recesses 28 are formed in the top face of the cam housing 12. The bearing recesses 30 are formed in the bottom face of the cam cap 14.

Two oil pipes 32 are provided integrally with the cam housing 12. Through the oil pipes 32, lubricant oil (hereinafter referred to simply as "oil") is supplied to the lash adjusters 24. Because the oil pipes 32 are integral with the cam housing 12, the oil pipes 32 can be formed at the same time when, for example, the cam housing 12 is formed.

The oil pipes 32 extend substantially parallel to the axes of the camshafts 16 and through the thicknesses of the partitions 12*b*. Each oil pipe 32 has a center hole 34 running through the axis thereof. The center hole 34 is an oil path. An oil pump pumps up oil from an oil pan. The oil is then forced through the center hole 34 to the lash adjusters 24. Each oil pipe 32 corresponds to an "oil flow path".

As illustrated in FIG. 3, bore portions 36 for mounting the lash adjusters 24 are provided integrally with the cam housing 12. In other words, the oil pipes 32 are provided integrally with the cam housing 12, and the bore portions 36 are provided integrally with outer circumferential surfaces of the oil pipes 32.

Figure 5:
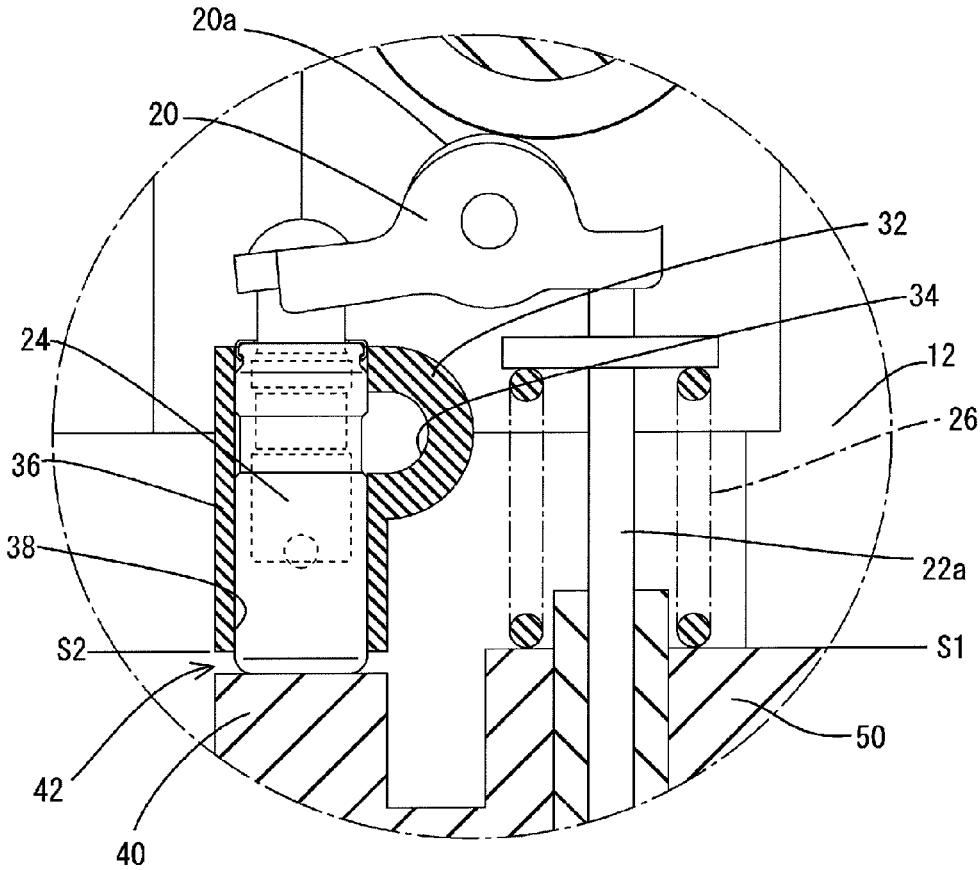
FIG. 5 is an enlarged sectional view of a cylinder head and a lash adjuster.

Each bore portion 36 is substantially cylindrical, and a mounting bore 38 is formed in the inside of the bore portion 36 (see FIG. 5). The top and bottom ends of the mounting bore 38 are open. The lash adjuster 24 is fitted in the mounting bore 38 in close contact with the inner surface of the mounting bore 38.

On the other hand, as illustrated in FIGS. 4 and 5, substantially columnar cylindrical base portions 40 are provided integrally with the cylinder head 50 at the top surface of the cylinder head 50 so as to protrude upward. Each base portion 40 supports a bottom surface of the corresponding lash adjuster 24 from below.

Furthermore, as illustrated in FIG. 5, there is a clearance 42 having a predetermined size between the bottom end of the bore portion 36 and the top surface of the base portion 40.

Operational functions achieved by the vehicle engine 10 will now be described.

In the vehicle engine 10 of this embodiment, the base portion 40 for supporting the bottom surface of the lash adjuster 24 is provided integrally with the cylinder head 50. Therefore, the base portion 40 can receive the pressure of the cam 18 exerted on the lash adjuster 24, while the cam housing 12 does not have to receive the pressure of the cams 18 exerted on the lash adjusters 24. As a result of this, the cam housing 12 does not have to have a higher rigidity, and the thickness of the cam housing 12 can be less. This makes it possible to downsize and reduce the weight of the cam housing 12.

In the vehicle engine 10 of this embodiment, the clearance 42 is provided between the bottom end of the bore portion 36 and the top surface of the base portion 40. Accordingly, when mounting the lash adjusters 24 in the bore portion 36, air in the bore portion 36 can be bled from the clearance 42. As a result of this, unlike conventional vehicle engines, providing air-bleed holes in the cylinder head 50 or in the cam housing 12 by cutting etc. for bleeding air when mounting the lash adjusters 24 is unnecessary. This makes it possible to reduce the processing cost and the material cost of the vehicle engine 10.

In the vehicle engine 10 of this embodiment, the oil pipe 32 for supplying oil to the lash adjuster 24 is provided integrally with the cam housing 12. Accordingly, unlike conventional vehicle engines, providing an oil supply path in the cylinder head 50 by cutting etc. for supplying oil to the lash adjuster 24 is unnecessary. Furthermore, by partially coarse-material molding the oil pipe 32, which is molded integrally with the cam housing 12, with casting etc., the processing cost and the material cost of the vehicle engine 10 can be reduced.

In the vehicle engine 10 of this embodiment, the clearance 42 is provided between the bottom end of the bore portion 36 and the top surface of the base portion 40 as illustrated in FIG. 5. Accordingly, because the bottom end of the bore portion 36 does not contact and interfere the top surface of the base portion 40, the difference in level between a bottom surface S2 of the bore portion 36 and a tightening surface S1 to the cylinder head 50 of the cam housing 12 can be within a wider tolerance. In other words, precision machining the cam housing 12 to create a predetermined difference in level between the tightening surface S1 and the bottom surface S2 of the bore portion 36 is unnecessary. Because precision machining the cylinder head 50 is thus unnecessary, the processing cost of the cylinder head 50 can be reduced.

<Other Embodiments>

The present invention is not limited to the embodiment described above with the drawings. For example, following embodiments are also included within the scope of the present invention. Further various variations other than the following embodiments are also possible within the scope and spirit of the invention.

(1) In the above embodiment, the supporting member that supports the one end of the rocker arm 20 from below is illustratively the lash adjuster 24. The present invention is not limited to this. For example, the supporting member may be a solid pivot.

(2) In the above embodiment, the shape of the base portion 40 is illustratively columnar. The present invention is not limited to this. The shape of the base portion 40 may be, for example, substantially rectangular parallelepiped.

What is claimed is:

1. A vehicle engine comprising:

a cylinder head having a main surface;

a cam housing arranged on the main surface of the cylinder head;

a cam cap fixed to the cam housing;

a camshaft rotatably supported between the cam housing and the cam cap;

a cam provided around the camshaft;

a rocker arm pushed by the cam;

a cylindrical member which is integral with the cam housing, the cylindrical member having a bore therein;

a supporting member that supports one end of the rocker arm from below, the supporting member being disposed in the bore of the cylindrical member; and a base portion which is integral with the main surface of the cylinder head, wherein a bottom surface of the supporting member is in contact with the base portion.

2. The vehicle engine of claim 1, wherein a clearance is provided between a bottom end of the cylindrical member and a top surface of the base portion.

3. The vehicle engine of claim 2, wherein the clearance is provided around an entire outer periphery of the supporting member such that the bottom end of the cylindrical member is not in contact with the base portion.

4. The vehicle engine of claim 2, wherein the base portion projects from the main surface of the cylinder head toward the bottom surface of the supporting member.

5. The vehicle engine of claim 4, further comprising:

a plurality of cylindrical members which are integral with the cam housing, each of the cylindrical members having a bore therein;

a plurality of base portions integral with the main surface of the cylinder head; and a plurality of supporting members disposed respectively in the bores of the cylindrical members, wherein bottom surfaces of the supporting members contact the base portions, respectively.

6. The vehicle engine of claim 5, wherein the clearance is provided around an entire outer periphery of the supporting member such that the bottom end of the cylindrical member is not in contact with the base portion.

7. The vehicle engine of claim 1, further comprising an oil flow path for supplying oil to the supporting member, wherein the supporting member is a hydraulic lash adjuster; and wherein the oil flow path is integral with the cam housing.

8. The vehicle engine of claim 1, wherein the base portion projects from the main surface of the cylinder head toward the bottom surface of the supporting member.

9. The vehicle engine of claim 8, further comprising:

a plurality of cylindrical members which are integral with the cam housing, each of the cylindrical members having a bore therein;

a plurality of base portions integral with the main surface of the cylinder head; and a plurality of supporting members disposed respectively in the bores of the cylindrical members, wherein bottom surfaces of the supporting members contact the base portions, respectively.

10. The vehicle engine of claim 1, wherein the cylindrical member is provided independently from the cylinder head.

11. A vehicle engine comprising:

a cylinder head;

a cam housing;

a cam cap fixed to the cam housing;

a camshaft rotatably supported between the cam housing and the cam cap;

a cam provided around the camshaft;

a rocker arm pushed by the cam;

a cylindrical member which is integral with the cam housing, the cylindrical member having a bore therein;

a supporting member that supports one end of the rocker arm from below, the supporting member being disposed in the bore of the cylindrical member; and a base portion which is integral with the cylinder head, wherein a bottom surface of the supporting member is in contact with the base portion, wherein the cam housing is separate from the cylinder head, a clearance is provided between a bottom end of the cylindrical member and a top surface of the base portion, and the clearance extends around an entire outer periphery of the supporting member in a radial direction of the supporting member such that the cylindrical member does not contact the cylinder head.

12. The vehicle engine of claim 11, wherein the base portion projects from a surface of the cylinder head toward the bottom surface of the supporting member.

13. The vehicle engine of claim 11, further comprising:

a plurality of cylindrical members which are integral with the cam housing, each of the cylindrical members having a bore therein;

a plurality of base portions integral with the main surface of the cylinder head; and a plurality of supporting members disposed respectively in the bores of the cylindrical members, wherein bottom surfaces of the supporting members contact the base portions, respectively.

14. The vehicle engine of claim 11, further comprising an oil flow path for supplying oil to the supporting member, wherein the supporting member is a hydraulic lash adjuster; and wherein the oil flow path is integral with the cam housing.

* * * * *